US006837635B1

(12) United States Patent
Juan

(10) Patent No.: US 6,837,635 B1
(45) Date of Patent: Jan. 4, 2005

(54) INKJET APPARATUS AND METHOD FOR CONTROLLING UNDULATION ON MEDIA

(75) Inventor: Fernando Juan, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/506,721

(22) Filed: Feb. 18, 2000

(30) Foreign Application Priority Data

Mar. 8, 1999 (EP) ..... 99104550

(51) Int. Cl.[7] ..... B41J 13/02

(52) U.S. Cl. ..... 400/636; 400/636.3; 400/641; 271/182

(58) Field of Search ..... 400/579, 592, 400/618, 633, 636, 636.3, 641, 599.1, 600.3, 602; 347/37, 101, 104, 105; 271/182, 183, 275, 314, 306, 121, 122, 124, 125

(56) References Cited

U.S. PATENT DOCUMENTS

| | | | | | |
|---|---|---|---|---|---|
| 4,158,456 | A | * | 6/1979 | Holland-Letz | 271/125 |
| 4,420,149 | A | * | 12/1983 | Schultes et al. | 271/122 |
| 4,822,019 | A | * | 4/1989 | Nagira | 271/9.02 |
| 5,083,879 | A | * | 1/1992 | Sato et al. | 400/579 |
| 5,085,420 | A | * | 2/1992 | Sata | 271/114 |
| 5,146,238 | A | * | 9/1992 | Numabe et al. | 347/220 |
| 5,172,899 | A | * | 12/1992 | Tajima | 271/122 |
| 5,172,989 | A | * | 12/1992 | Imaseki et al. | 400/618 |
| 5,182,861 | A | * | 2/1993 | Suzuki et al. | 33/18.1 |
| 5,342,133 | A | * | 8/1994 | Canfield | 400/635 |
| 5,363,129 | A | | 11/1994 | Kline et al. | 346/136 |
| 5,454,648 | A | * | 10/1995 | Lee | 400/645 |
| 5,485,991 | A | * | 1/1996 | Hirano et al. | 271/121 |
| 5,540,427 | A | * | 7/1996 | Nitta | 271/274 |
| 5,547,179 | A | * | 8/1996 | Wilcox et al. | 271/3.2 |
| 5,646,667 | A | * | 7/1997 | Broder et al. | 347/104 |
| 5,678,817 | A | * | 10/1997 | Saito et al. | 271/122 |
| 5,795,087 | A | | 8/1998 | Brower et al. | 400/636 |
| 5,833,230 | A | * | 11/1998 | Nakagawa et al. | 271/121 |
| 5,874,979 | A | * | 2/1999 | Ohyama | 341/104 |
| 5,938,356 | A | * | 8/1999 | Wirth et al. | 400/636.3 |
| 5,957,599 | A | * | 9/1999 | Yamada | 400/636 |
| 6,179,419 | B1 | * | 1/2001 | Rasmussen et al. | 347/104 |
| 6,196,541 | B1 | * | 3/2001 | Silverbrook | 271/188 |
| 6,367,999 | B1 | * | 4/2002 | Juan et al. | 400/645 |

FOREIGN PATENT DOCUMENTS

| | | | |
|---|---|---|---|
| JP | 63-21166 | 1/1988 | B41J/13/10 |
| JP | 63021166 | 1/1988 | B41J/13/10 |
| JP | 04039247 | 2/1992 | B41J/13/10 |
| JP | 07300251 | 11/1995 | B65H/5/06 |
| JP | 8-259029 A | 10/1996 | B65H/5/06 |
| JP | 08259029 | 10/1996 | B65H/5/06 |

* cited by examiner

*Primary Examiner*—Stephen R. Funk

(57) ABSTRACT

An inkjet apparatus includes a media drive means for moving a medium through a print zone of the apparatus, and also includes a carriage, in which a printhead is mounted, for traversing the pint zone in a second direction. The apparatus also includes restraining means, co-operating with the drive means, to restrain the advance of a first portion of the medium through the print zone when moved by the drive means. A method for controlling undulation on media in a inkjet apparatus includes moving a medium through the print zone, and restraining the movement through the print zone of a first portion of the medium.

17 Claims, 3 Drawing Sheets

INKJET APPARATUS AND METHOD FOR CONTROLLING UNDULATION ON MEDIA

FIELD OF THE INVENTION

The present invention generally relates to ink-jet apparatus, including inkjet printing mechanisms, and more particularly to improved mechanism for controlling printhead crashes for such apparatus.

BACKGROUND OF THE INVENTION

Inkjet printing mechanisms may be used in a variety of different inkjet apparatus, such as plotters, facsimile machines, copiers, and inkjet printers collectively called in the following as printers, to print images using a colorant, referred to generally herein as "ink". These inkjet printing mechanisms use inkjet cartridges, often called "pens" or "printheads" to shoot drops of ink onto print media, which can be used in the form of cut sheets or rolls of print media.

In the following, for sake of simplicity, with the term "sheet" or "medium" we refer to any generic kind of print media, e.g. paper, vinyl, films, canvas or the like, produced in any form, e.g. cut sheets or rolls, and of any dimensions.

Some inkjet print mechanisms carry an ink cartridge with an entire supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multicolour cartridges, several printheads and reservoirs are combined into a single unit, with each reservoir/printhead combination for a given color also being referred to herein as a "pen."

Each pen has a nozzle plate that includes very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporisation chambers is located between a nozzle orifice plate and a substrate layer. This substrate layer typically contains linear arrays of heater elements, such as resistors, which are energised to heat ink within the vaporisation chambers. Upon heating, an ink droplet is ejected from a nozzle associated with the energised resistor.

To print an image, the printhead is scanned back and forth across a printzone at a very close distance above the sheet, with the pen shooting drops of ink as it moves. By selectively energising the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and substantially perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The height of this band is known as the "swath height" of the pen, the maximum pattern of ink which can be laid down in a single pass.

For placing the remaining print swath on the print media known mechanism are then employed to advance or index the medium in the print zone, in a second direction, also called media direction, which is usually substantially perpendicular to scanning direction of the printhead.

U.S. Pat. No. 5,363,129 describes a printing media feed and retaining apparatus which has a plurality of pinch rollers mounted on a single pinch roller support member co-operating with a main drive roller to precisely advance the media in the media direction and control the spacing between the printhead and the surface of the sheet on which printing is to take place.

However, in known printers, when a lot of ink is placed on the sheet in order to print the image, the sheet expands, and this effects are know as media "curl" and "cockle".

Very often the result of this effect is more problematic near the sheet edges due to the way the deformation occurs. In fact, this expansion may generate at the sheet edge a wave high up to 2–3 mm within the printzone causing the crash of the pen.

The crash of a pen against the medium may seriously affect the print quality or the throughput of the printer due to damages to the pen itself, which can be very persistent or even permanent. In fact it may generate, in the pen, a large number of malfunctioning nozzles which can be hardly replaced with success by working ones to maintain the same print quality or the recovery services of the pen would be repetitively activated to attempt to recover the malfunctioning nozzles.

SUMMARY OF THE INVENTION

The present invention seek to provide an improved ink-jet apparatus and method of controlling the cockle generation on the printed medium preferably in the printzone.

According to an aspect of the present invention there is provided an inkjet apparatus comprising a media drive means to move, in a first direction, a medium through a print zone of the apparatus and a carriage, in which a printhead is mounted, traversing in a second direction said print zone, characterised by comprising restraining means, co-operating with said drive means, to restrain the advance of a first portion of the medium through the printzone when moved by the drive means.

This means that when there is a paper expansion, this sort of media brake effect is able to move the generated undulation away from the printzone. In particular, this effect helps the wave deformation of the medium to be moved backward to the rear side of the pinch wheel, out of the print zone where there is a reduced risk of crashing the printhead.

Preferably, said first portion of the medium includes parts of at least one edge of the medium.

This specifically reduces the occurrence of printhead crashes which are more often caused by cockles close to the sheet edges.

Preferably, said restraining means comprise a first and a second segments, the first segment being driven by the medium and the second segment applying a restraining force to the medium.

In a preferred embodiment said restraining means comprise a plurality of rotary members, each rotary member having two end segments, at least one of said plurality of rotary members having one end segment with a cross section smaller than the cross section of the other end segment.

In this way the same angular velocity is generated on both the two end segments, so that each end segment can produce on the medium a different speed of advance, i.e. one of the two end segments is applying a relative restraining force to a portion of media while the media is advancing.

More preferably, two rotary members of said plurality of rotary members have one end segment with a cross section smaller than the cross section of the other end segment, each rotary member of said two rotary members being placed to co-operate with said drive means substantially at one corresponding end of the print zone.

Placing the rotary members having the smaller cross section at the extremities of the printzone, gives the additional benefit of allowing the more accurate control of the media having the bigger size which are the ones more affected by the cockles generation. In fact, even though media of the same type of any size are affected by a similar expansion in percentage when printed, this expansion may results in a lower (and so less dangerous) cockle when smaller sized media is employed due to their smaller absolute expansion.

In a further preferred embodiment, the segment of the rotary member having smaller cross section is placed to be in contact with the first portion. Typically, the end segment having smaller cross section of the rotary member is moved at a velocity which is smaller than the velocity of movement of the first portion of the medium, to generate an force opposite to the movement direction of the medium.

Viewing another aspect of the present invention, there is also provided a method for controlling undulation on media in an inkjet apparatus comprising a printzone, including the step of moving a medium through the printzone, by restraining the movement through the print zone of a first portion of the medium.

Preferably, said first portion includes at least one edge of the medium, and said step of moving the medium includes the steps of moving a first portion of the medium at a first speed and a second portion of the media at a second speed, said first speed being smaller than said second speed.

BRIEF DESCRIPTION OF THE DRAWINGS

The present invention will be described further, by way of example only, with reference to an embodiment thereof as illustrated in the accompanying drawings in which.

DETAILED DESCRIPTION OF THE INVENTION

Figure 1:
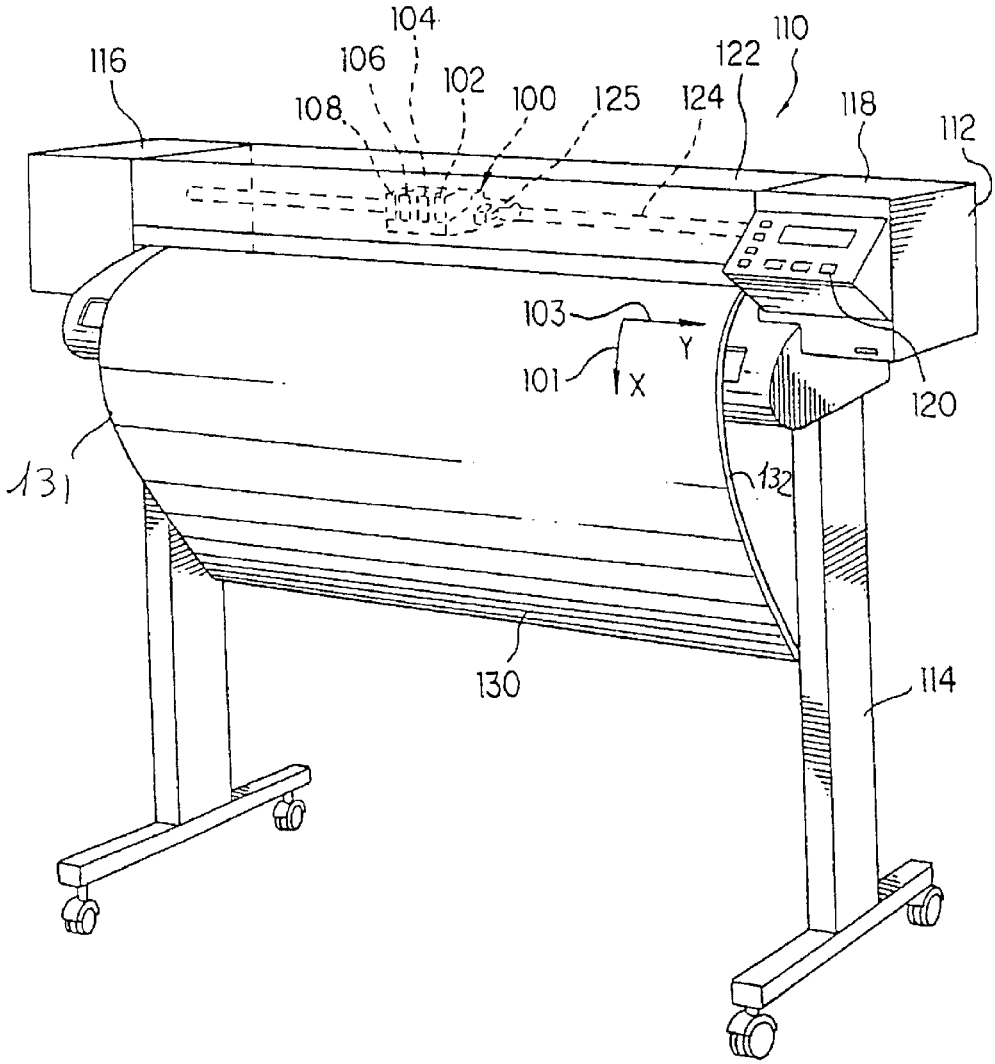
FIG. 1 is a perspective view of an inkjet printer incorporating the features of the present invention.

Referring to FIG. 1, a printer 110 includes a housing 112 mounted on a stand 114. The housing has left and right drive mechanism enclosures 116 and 118. A control panel 120 is mounted on the right enclosure 118. A carriage assembly 100 illustrated in phantom under a cover 122, is adapted for reciprocal motion along a carriage bar 124, also shown in phantom. The carriage assembly 100 comprises four inkjet printheads 102, 104, 106, 108 that store ink of different colours, e.g. black, magenta, cyan and yellow ink respectively, and an optical sensor 105. As the carriage assembly 100 translates relative to the medium 130 along the X and Y axis selected nozzles of the printheads 102, 104, 106, 108 are activated and ink is applied to the medium 130, having two edges 131, and 132. The colours from the three colour printheads are mixed to obtain any other particular colour. The position of the carriage assembly 100 in a horizontal or carriage scan axis (Y) is determined by a carriage positioning mechanism with respect to an encoder strip. (not shown). A print medium 130 such as paper is positioned along a vertical or media axis by a media axis mechanism (not shown). As used herein, the media axis is called the X axis denoted as 101, and the scan axis is called the Y axis denoted as 103.

Figure 2:
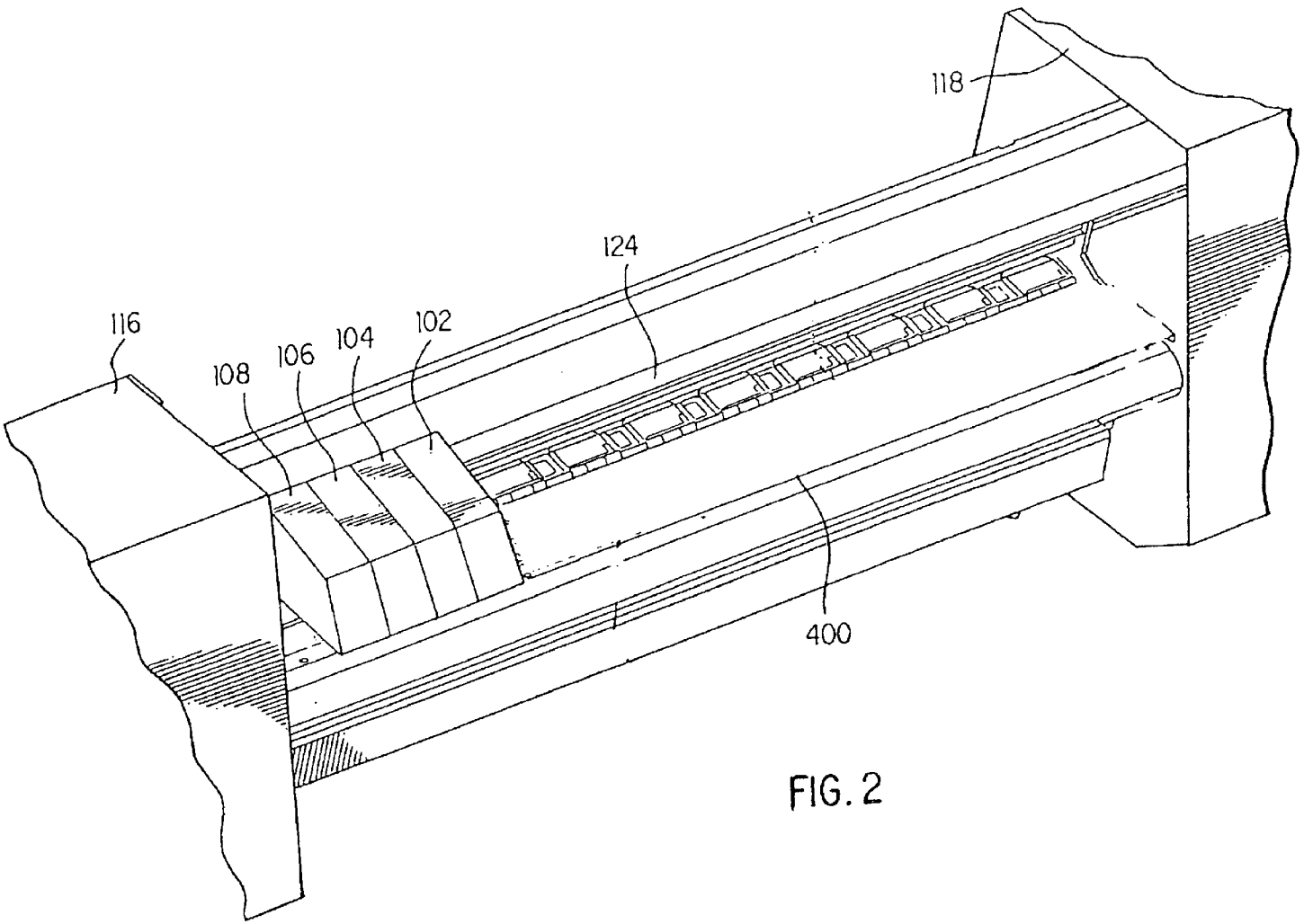
FIG. 2 is a more detailed diagram of a portion of the printer of FIG. 1.

Referring now to FIG. 2, a flat stationary support platen 400 is located between the left and right drive mechanism enclosures 116 and 118. The width of the platen 400 along the Y axis, or scan axis, is at least equal to the maximum allowable width of the media. In this example it should allow the employment of media having width up to 36 inches, i.e. 914 mm. The inkjet printheads 102, 104, 106, 108, are held rigidly in the movable carriage 100 so that the printhead nozzles can scan above the surface of the medium 130 laying substantially flat on the platen 400.

Figure 3:
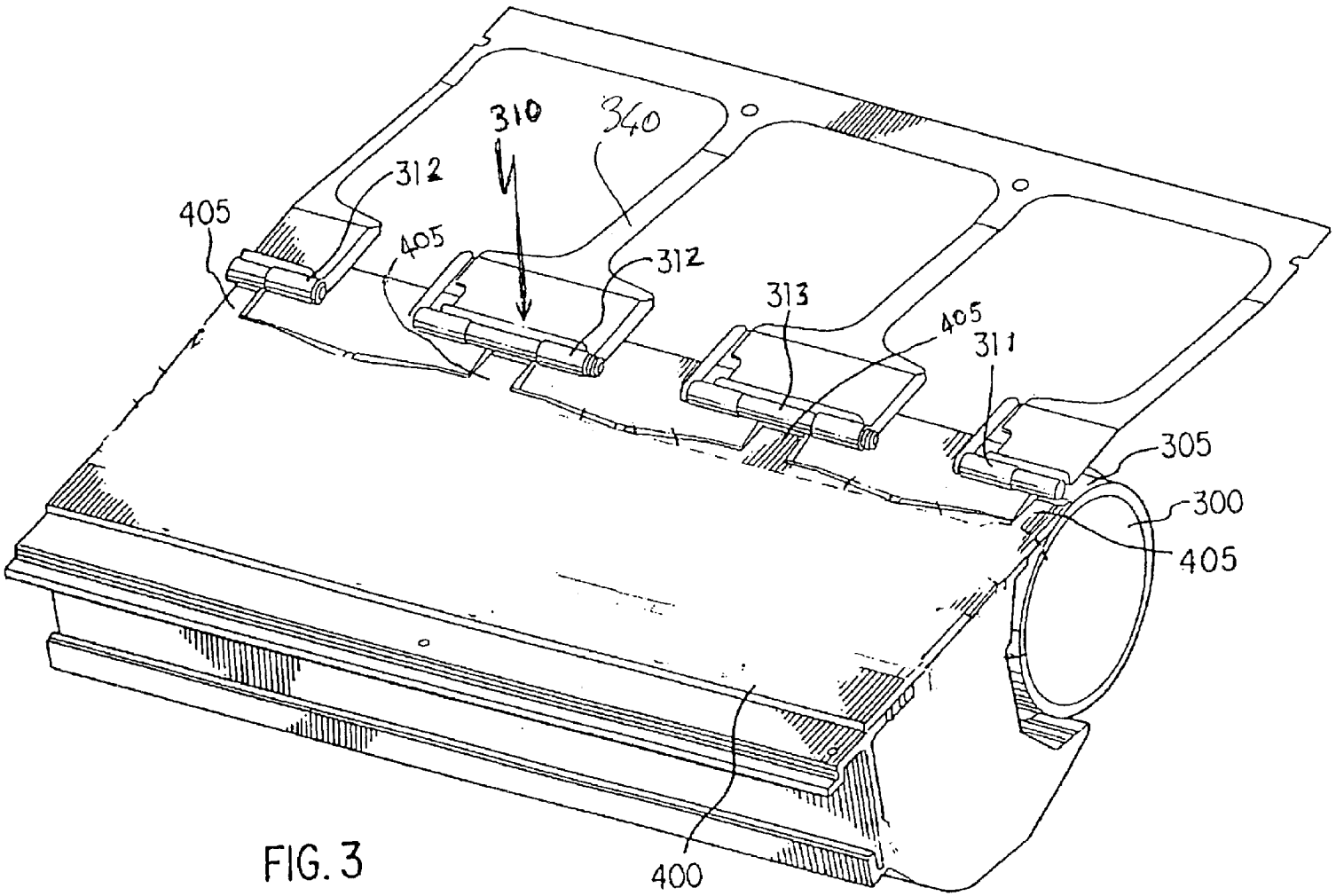
FIG. 3 depicts a more detailed view of the components to drive media of the printer of FIG. 1

With reference to FIG. 3, the flat platen 400 is shown in more details, and is located in a front position of the printer 110 and co-operate with a main driving roller 300, in the following identified also as the main roller, located in a rear position, and a plurality of rotary members, in this example pinch wheels, also called pinch rollers, 310, in this example 12 pinch wheels 310 are employed, which are controlled to periodically index or convey the medium across the surface of the platen 400. The force between each pinch wheels 310 and the main roller 300 is comprised between 3.33 N and 5 N, preferably 4.15 N and is applied by a plurality of springs 340. The main roller 300 is preferably made of a softer material such as rubber, to increase the friction with the medium, while the pinch wheels are made of a harder material such as plastic.

This pinch wheel distribution and force helps to drive the medium 130 straight with irrelevant lateral slippage, to share the medium 130 expansion on all its width. In fact it has been observed that printers with low forces, e.g. about 1 N, allow media expansion to accumulates in a particular place and this may cause a wrinkle to get so big to create a crash of the printhead.

The main roller 300 is provided with a conventional surface having a plurality of circumferencial recesses 305 housing a corresponding plurality of protrusions 405 of the platen 400 extending towards the rear of the printer 110. This combination of features allows the medium 130 to reliably move from the main roller 300 to the platen 400 and vice versa. In fact the gap between the main roller 300 and the platen 400 may allow an edge of the medium to engage the A back of the platen itself causing a paper jam.

According to the present embodiment each pinch wheel 310 is formed by two cylindrical end segments 311 and 312 preferably having substantially the same length, which are designed to be in contact with the medium, thus co-operating with the main roller 300 for its precise indexing in the print zone. The end segments 311, 312 are joined by a third central cylindrical segment 313 having a longer length and a smaller diameter of both the two end segments, preferably of about 5 mm so that it is not in touch with the medium.

The diameter of the two ends of a pinch wheel 310 may either be substantially the same or differ depending on the position the pinch wheel along the scan axis.

In this embodiment all the pinch wheels 310, but the first and the last pinwheels, have both the end segments having substantially the same diameter of 6 mm.

On the contrary the two end segments which face the two ends of the printer 118 116, i.e. pertaining a first end segment 312 to the first pinch wheel and a final end segment 311 to the last pinch wheel, have a diameter slightly smaller than the diameter of the corresponding opposite end segment which maintains the standard diameter of 6 mm.

If the base of the two end cylindrical segments is not circular, e.g. oval, instead of considering the diameter of the base of the two end segments, it is taken into account the cross section of the segments, i.e. the surface of the base of the segments.

According to some tests run by the Applicant, the diameter dimension of the smaller end segments is preferably between 0.2% and 0.7% smaller than the diameter dimension of the remaining end segments, and more preferably about 0.4%, i.e. in this embodiment it may vary between 5.9 mm and 5.6 mm and preferably is about 5.8 mm. This allows both ends to pinch the medium against the main roller 300.

It is important to notice that the pinch wheel having different sized end segments acts like a brake on the media.

When a sheet 130 of media is driven by the main roller 300, it drives also the pinch wheels 310 which are in contact with the media.

The pinch wheel 310 is an element which rotates at a given angular velocity co, which is dependent on the velocity of the sheet (depending on the angular velocity of the main roller 300). Thus, even if the two end segments 311, 312 of a single pinch wheel 310 have different dimensions, both end segments should move at a different angular velocity $\omega_1$ and $\omega_2$. However, since the two segment are linked one to the other, they have to move at the same angular velocity as imposed by the sheet. In this case the segment having bigger diameter will transfer its angular velocity to the other segment.

Thus the linear velocity of the pinch wheel 310 when exiting from a given pinch wheel 310 may vary depending on the diameter of the portion pinching the sheet itself, i.e. the diameter of the two different end segments 311, 312. In fact, the velocity, in this case linear velocity due to the flat platen, of the smaller end 311, 312 of the pinch wheel 310 may be smaller than the velocity of the sheet, thus generating on the portion of the sheet, which is in contact with the smaller end 311, 312, a force which is opposite to the advance direction of the sheet.

This means that if the edges of the sheet are in contact with the end segments 311, 312 having smaller diameter, while the rest of the sheet is in contact with the end segments having bigger diameter, the edges of the sheet 131, 132 can perceive nip forces at a lower linear velocity that the rest of the sheet.

This break effect helps the wave deformation located close to the edge of the sheet 131, 132 to be moved backward to the rear side of the pinch wheel 310, i.e. out of the printzone, where there is no risk of crashing the printhead.

In fact when a cockle is generated on the medium 130 usually it is moving towards the edge of the sheet 131, 132 and tries to go backward, i.e. in a direction opposite to the media advance direction, but it is stopped by the presence of the pinch wheel 310, tightly co-operating with the main roller 300 to advance the media 130. Thus, this modified pinch wheel 310, as explained before, is helping the wave to move backward the pinch wheel itself.

When there is no media expansion the Applicant has verified that this brake effect, which is still generated by the end segment of the pinch wheel 310 having smaller diameter, is not causing any apparent damages on any kind of sheet, even on the rice type media.

In this case this end segment is smoothly slipping on the edge of the sheet, which is advancing at a speed higher than the speed intended by this end segment.

The skilled in the art may appreciate that, preferably in printers wider than 36 inches, more pinch wheels, having end segments with different cross sections, may be distributed along the scan axis.

This allows to control undulation of media at both the edges of the medium not only when its size is equivalent to the size of the platen, i.e. 36 inches.

In this way the undulation of media when generated on both edges can be controlled also for most or all the different sized media which can be loaded in the printer.

However, any sized media of the same type are affected by a similar expansion in percentage when printed, but this may results in a lower (and so less dangerous) wrinkles when smaller sized media is employed due to their smaller absolute expansion. Accordingly, printers wider than 36 inches or less may perform good undulation control by employing only two pinch wheels having differently dimensioned end sections.

What is claimed is:

1. An inkjet apparatus comprising:

a media driver that applies a first force for moving a medium through a print zone of the apparatus in a first direction (X), wherein said medium includes at least a first portion and a second portion, and wherein said first force is applied in at least one location of said first portion to cause at least said first portion to move at a first speed;

a carriage, in which a printhead is mounted, for traversing said print zone in a second direction (Y); and a restraining member, co-operating with said media driver and positioned to apply a second force to the medium, to restrain the advance of said second portion of the medium through the print zone when moved by said media driver, said first and second forces being applied substantially at the same time and causing the second portion to be moved at a second speed different from said first speed.

2. An apparatus as claimed in claim 1, wherein said second portion of the medium is at least one edge of the medium.

3. An apparatus as claimed in claim 1, wherein said restraining member comprises a plurality of rotary members, each rotary member having two end segments, at least one of said plurality of rotary members having one end segment with a cross section smaller than the cross section of the other end segment.

4. An apparatus as claimed in claim 3, wherein two rotary members of said plurality of rotary members have one end segment with a cross section smaller than the cross section of the other end segment, each rotary member of said two rotary members being placed to co-operate with said media driver substantially at one corresponding end of the printzone.

5. An apparatus as claimed in claim 3 wherein the end segment of the rotary member having smaller cross section is placed to be in contact with said second portion of the medium.

6. An apparatus as claimed in claim 5 wherein the end segment having smaller cross section of the rotary member is moved at a velocity which is smaller than the velocity of movement of said second portion of the medium, to generate said second force opposite to the movement direction of the medium.

7. An apparatus as claimed in claim 1, wherein said restraining member comprises at least one spring disposed to cause the application of both said first and second forces.

8. A method for controlling undulation on media in an inkjet apparatus comprising a print zone, said method comprising:

moving a medium through the print zone by applying a first force to a first portion of said medium to move said first portion at a first speed; and applying a second force to a second portion of the medium to move said second portion at a second speed different from said first speed, said steps of moving and applying said second force being performed substantially at the same time.

9. A method as claimed in claim 8, wherein said second portion includes at least one edge of the medium.

10. A method for controlling undulation on media in an inkjet apparatus comprising a print zone, said method comprising:

moving a medium through the print zone by applying a first force to a first portion of the medium to move said first portion at a first speed; and restraining the movement through the print zone of at least a second portion of the medium, wherein said step of restraining the movement includes the steps of actuating a restraining means by moving the medium, and applying on the second portion of the medium, by means of the restraining means, a second force which causes the second portion to move at a second speed lower than the first speed.

11. An inkjet apparatus comprising:

a media driver that applies a first force for moving a medium through a print zone of the apparatus in a first direction, said medium including a first portion; and a rotary member that applies a second force to the medium to restrain the advance of said first portion of the medium through the print zone when moved by a wheel, said first and second forces being applied substantially at the same time.

12. An apparatus as claimed in claim 11, wherein said first portion of the medium is at least one edge of the medium.

13. An apparatus as claimed in claim 11, wherein said rotary member comprises first and second segments, the first segment being driven by the medium and the second segment applying said second force to the medium.

14. An inkjet apparatus comprising:

a media driver that applies a first force for moving a medium through a print zone of the apparatus in a first direction; and a plurality of rotary members, each rotary member having two end segments, at least one of said plurality of rotary members having one end segment with a cross section smaller than a cross section of the other end segment, and wherein the end segment having the smaller cross section of the rotary member is moved at a velocity which is smaller than the velocity of movement of said medium in said first direction, to generate a second force opposite to the movement direction of the medium.

15. An inkjet apparatus as claimed in claim 14, wherein two rotary members of said plurality of rotary members have one end segment with a cross section smaller than a cross section of the other end segment, each rotary member of said two rotary members being placed to cooperate with said media driver substantially at one corresponding end of the print zone.

16. An apparatus as claimed in claim 14, wherein the end segment of the rotary member having smaller cross section is placed to be in contact with a first portion of medium.

17. A method for controlling undulation on media in an inkjet apparatus comprising a print zone, said method comprising:

moving a medium through the print zone; and restraining the movement through the print zone of a first portion of the medium by actuating a rotary member which applies on the first portion of the medium a force which is opposite to the movement of the medium, said steps of moving and restraining being performed substantially at the same time.

* * * * *

UNITED STATES PATENT AND TRADEMARK OFFICE

CERTIFICATE OF CORRECTION

PATENT NO. : 6,837,635 B1
APPLICATION NO. : 09/506721
DATED : January 4, 2005
INVENTOR(S) : Fernando Juan It is certified that error appears in the above-identified patent and that said Letters Patent is hereby corrected as shown below:

In column 3, line 63, after "sensor" delete "105." and insert -- 125. --, therefor.

In column 4, line 50, before "back" delete "A".

In column 4, line 64, delete "pinwheels," and insert -- pinch wheels, --, therefor.

In column 5, line 23, after "velocity" delete "co," and insert -- ω, --, therefor.

Signed and Sealed this

Third Day of November, 2009

David J. Kappos

David J. Kappos
*Director of the United States Patent and Trademark Office*